United States Patent [19]

Taylor

[11] 4,441,347

[45] Apr. 10, 1984

[54] LOCK ASSEMBLY WITH INTERCHANGEABLE NOSES FOR SAFE DEPOSIT BOXES

[76] Inventor: James L. Taylor, P.O. Box 4441, Lexington, Ky. 40544

[21] Appl. No.: 271,571

[22] Filed: Jun. 8, 1981

[51] Int. Cl.[3] ..... E05B 9/08; E04G 3/00

[52] U.S. Cl. ..... 70/370; 70/451; 248/222.3

[58] Field of Search ..... 70/370–372, 70/224, 374, 466, 451; 248/27.1, 27.3, 222.3; 24/221 R

[56] References Cited

U.S. PATENT DOCUMENTS

| | | | |
|---|---|---|---|
| 549,134 | 11/1895 | Judd | 70/370 |
| 696,067 | 3/1902 | Mix . | |
| 713,244 | 11/1902 | Roche | 70/370 |
| 721,802 | 3/1903 | Horne | 70/370 |
| 1,042,297 | 10/1912 | Voight | 70/370 |
| 1,338,221 | 4/1920 | Greenleaf | 248/27.1 |
| 1,441,394 | 1/1923 | Blye . | |
| 2,046,630 | 7/1936 | Jacobi | 70/451 |
| 2,633,011 | 3/1953 | Poupitch | 70/370 |
| 2,745,275 | 5/1956 | Jacobi | 70/370 |
| 3,210,457 | 10/1965 | Hancock et al. | 248/27.3 |
| 3,279,728 | 10/1966 | Campbell | 248/27.1 |
| 3,368,779 | 2/1968 | Connine | 248/27.1 |
| 3,501,933 | 3/1970 | Carlsson | 70/371 |
| 4,012,928 | 3/1977 | Dauenbaugh . | |

FOREIGN PATENT DOCUMENTS

| | | | |
|---|---|---|---|
| 401571 | 9/1924 | Fed. Rep. of Germany | 70/370 |
| 537277 | 10/1931 | Fed. Rep. of Germany . | |
| 2003206 | 11/1969 | France | 248/27.1 |
| 2322441 | 2/1977 | France | 248/27 |

*Primary Examiner*—Gary L. Smith
*Assistant Examiner*—Lloyd A. Gall
*Attorney, Agent, or Firm*—King and Liles

[57] ABSTRACT

A safe deposit-type lock assembly having a fabricated metal cover plate and interchangeable lock noses or insert guides to provide the desired combination of big and little noses. The noses are cast metal provided with a universal size base having locking elements for engaging the cover plate. The locking elements include bayonet-type wings engaging the top surface of the cover plate and locking wedges engaging beneath resilient retainer arms stamped from the cover plate. A locking detent is provided between the retainer arms and the mating locking wedges. The safe deposit door is positioned flush on top of the retainer arms and wings to assure engagement of the detent once the lock is positioned on the back of the door. The heads of the lock plugs are received in the noses providing the desired match for previously installed boxes.

14 Claims, 4 Drawing Figures

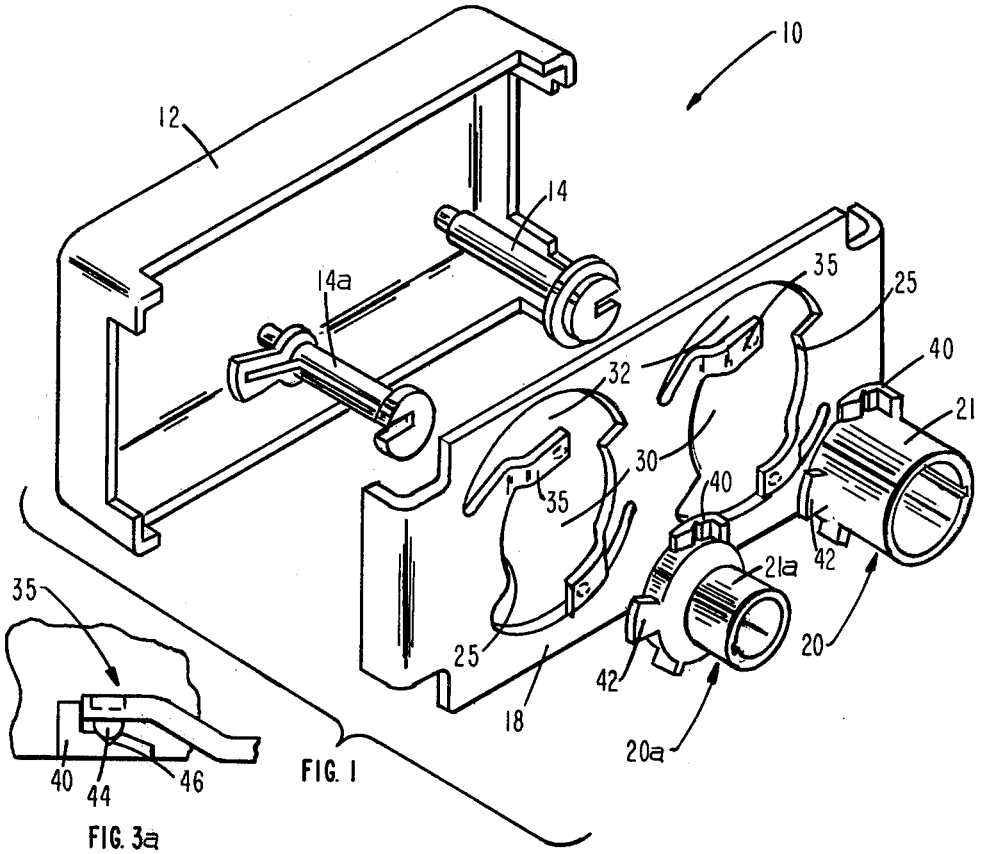
FIG. 1
FIG. 3a
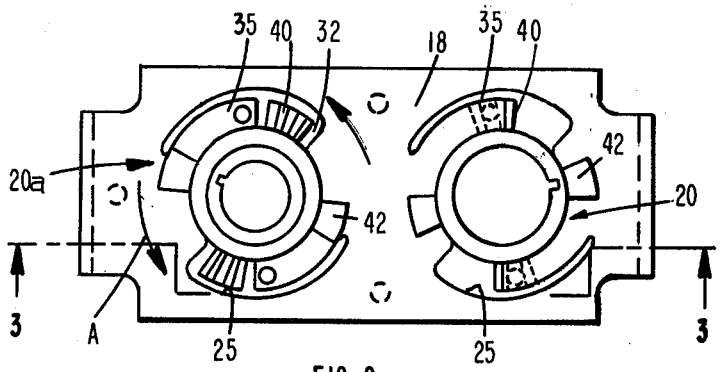
FIG. 2
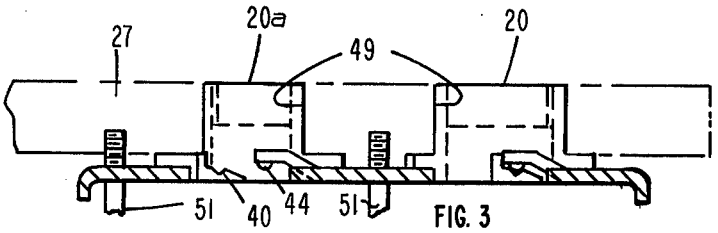
FIG. 3

LOCK ASSEMBLY WITH INTERCHANGEABLE NOSES FOR SAFE DEPOSIT BOXES

BACKGROUND OF THE INVENTION

This invention generally relates to lock mounting assemblies, and more particularly, to a lock mounting assembly for positioning differently sized lock plugs in a safe deposit door and the like.

Most banks include safe deposit facilities to offer customers safe storage of valuable papers, articles, and other personal effects. Such facilities typically include a number of safe deposit doors, each protecting a compartment assigned to individual persons. The doors lock the compartment area by means of a lock mechanism secured to the back of the door. Each locking mechanism typically includes a cover plate integrally formed with insert lock guides received in the door. Two insert lock guides are formed on the cover plate of each locking mechanism. Lock plugs mounted in the lock guides receive the keys to open the door; i.e. the bank official and customer each have separate keys, both being required to actuate the locking mechanism.

In the past, the insert lock guides, generally referred to in the trade, as "noses", are formed integrally with the cover plate in three basic combinations. For example, one leading manufacturer manufactures a casting with two large diameter "brass" nose inserts (big noses); another manufactures a die cast cover with a large nose-small nose combination; yet others manufacture cover plates with two small nose combinations.

As each bank expands its safe deposit facility, it is customary to have the new boxes with the same nose combination so that the wall of boxes are uniform and aesthetically pleasing. Also, it is customary to continue the same combination in each new branch facility. Thus, in the past a manufacturer would be required to set up different molds and machinery for die casting the cover plates having the various nose configurations, in order to meet the demands of different banks. Such requirements, in addition to increasing manufacturing costs, further require the manufacturer or supplier to maintain a substantial inventory of cover plates having different nose combinations.

SUMMARY OF THE INVENTION

An object of the invention is to provide a lock mounting assembly having a common cover plate and interchangeable lock guides or noses capable of easy and secure installation on a safe deposit door or the like to provide any desired combination of noses to match previously installed boxes.

It is another more specific object of the present invention to provide a lock mounting assembly having a common cover plate and separate differently sized insert lock guides or noses including a universal mounting base.

Still another object is to provide a lock mounting assembly having a stamped cover plate and noses of different sizes for mounting on the plate in a secure fashion.

Yet a further object is to provide a lock mounting assembly including a universal cover plate and insert noses capable of reducing supplier inventories and costs to the purchaser.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

The lock mounting assembly of the present invention is capable of accommodating any desired combination of insert lock guides (big nose, little nose configurations) in a safe deposit door and the like to meet individual customer needs. The lock mounting assembly includes a lock housing carrying a locking mechanism and a cover plate having cutout portions receiving the insert lock guides. Each insert lock guide includes a universal mounting base received in the cutout portions, and locking elements for engaging the cover plate. The locking elements include bayonet-type wings engaging the top of the cover plate and locking wedges engaging beneath resilient retainer arms stamped from the cover plate. These locking elements are spaced circumferentially from each other and share a common radius from the center of the mounting base.

Each insert lock guide is substantially cylindrical and, in the case of both little and big noses, includes a universal mounting base received in the correspondingly dimensioned circular cutout portions. Diametrically opposed crescent shaped slots communicating with the circular opening receive the locking wedges, and rotation of the insert lock guides causes the locking wedges to travel into engagement with the resilient retainer arms overlapping part of the crescent shaped slots. A locking detent provided between the retainer arms and the mating locking wedges assures locking engagement.

In position against a safe deposit door, the resilient retainer arms are positioned flush against the back of the door to ensure positive engagement of the locking detent with the recess to effectively resist withdrawal of the insert lock guides from the cover plate. Lock plugs are received in the insert lock guides for opening and closing the locking mechanism. With the above features, any desired combination of insert lock guides may be positioned in the cover plate in a secure manner to meet individual bank needs. The cover plate and insert lock guides are cost-effective to manufacture and reduce inventory requirements of suppliers.

BRIEF DESCRIPTION OF THE DRAWING

FIG. 1 is an exploded, perspective view of the lock mounting assembly according to the present invention, showing differently sized insert lock guides (big and little nose combination) before mounting on the cover plate;

FIG. 2 is a front plan view of insert lock guides received in the cutout portions of the cover plate, with the left hand insert lock guide (little nose) in unlocked position and the right hand insert lock guide (big nose) after being rotated into locked position;

FIG. 3 is an enlarged, partial sectional view taken along the line 3—3 of FIG. 2, showing attachment of the cover plate against the back of a safe deposit door to secure the insert lock guides to the cover plate in position for use; and FIG. 3*a* is an enlarged, partial elevational view of a locking wedge in mating engagement with a resilient retainer arm.

DETAILED DESCRIPTION OF THE PREFERRED EMBODIMENT

Reference is now made in detail to the present preferred embodiment of the invention, an example of which is illustrated in the accompanying drawing. Referring first to FIG. 1, lock mounting assembly 10 of the invention is shown in exploded view, and comprises a rectangular lock housing 12 for a lock mechanism (not shown) to be actuated by lock plugs 14, 14*a*. Lock housing 12 includes four corner projections engaging open corners of cover plate 18 for secure placement and mounting of the cover plate on the lock housing with screws or the like (not shown). A pair of insert lock guides 20, 20*a*, received in identical cutout portions 25 of cover plate 18, in a manner specifically set forth below, receive the corresponding lock plugs 14, 14*a* for opening and closing safe deposit door 27 (FIG. 3).

Insert lock guides 20, 20*a*, shown in FIG. 1, are cast metal, and respectively illustrate big and little "nose" configurations, each having a cylindrical body 21, 21*a*. The diameter of the cylindrical body 21*a* is less than the corresponding diameter of the cylindrical body 21; however, the lower part of cylindrical body 21*a* (little nose) includes a circular universal mounting base having a diameter substantially equal to the diameter of cylindrical body 21 (big nose). The corresponding lower part of cylindrical body 21 also constitutes a universal mounting base, enabling mounting of any desired combination of insert lock guides 20, 20*a* to provide the desired match for previously installed safe deposit doors and locking mechanisms.

Each cutout portion 25 includes a substantially circular opening 30 dimensioned to receive the universal mounting bases, as shown in FIG. 2. Two diametrically opposed crescent shaped slots 32, communicating with circular opening 30, each have a circumferential extent of approximately 120° and an opposite end extending away from the circular opening to define resilient retainer arms 35 stamped from the cover plate. Retainer arms 35 are located in diametrically opposed positions adjacent the circular opening. Each resilient retainer arm 35 extends clockwise and substantially overlaps the opposite end of crescent shaped slots 32 above cover plate 18 to receive locking wedges 40 in mating engagement, as will be apparent below.

Locking wedges 40 and bayonet type wings 42 project outwardly from the universal mounting bases. As best shown in FIGS. 1 and 2, with reference to insert lock guide 20*a* (little nose), two bayonet wings 42 are formed in diametrically opposed locations of the universal mounting base in substantially the same plane defined by resilient retainer arms 35 located above cover plate 18. Diametrically opposed locking wedges 40 are spaced apart from bayonet wings 42 by approximately 90°. The wedges extend arcuately from a lower part of the universal mounting base for mating, locking engagement beneath resilient retainer arms 35 (see FIGS. 3 and 3*a*).

Insert lock guides 20, 20*a* are thus mounted in cover plate 18 in the following manner. The universal mounting bases are positioned in circular openings 30 so bayonet wings 42 rest on the top of cover plate 18 while locking wedges 40 are received in crescent shaped slots 32 (see lock guide 20*a* in FIGS. 2 and 3). Thusly positioned, rotation of the insert lock guides in the direction of arrow A causes locking wedges 40 to travel in the crescent shaped slots and wedge beneath resilient retainer arms 35 in mating engagement (note lock guide 20 in FIGS. 2, 3 and 3*a*). The resilient retainer arms include locking detent 44 engaging a corresponding recess 46 in the locking wedge to maintain insert lock guides 20, 20*a* in locked position, as discussed below. Axial movement of the insert lock guides in cutout portions 25 is prevented by virtue of the bayonet wings 42 engaging the top of cover plate 18 while locking wedges 40 engage beneath the bottom surface of resilient retainer arms 35.

In the locked position of the guides 20, 20*a*, the cover plate 18 is mounted on the housing 12. The heads of the lock plugs 14, 14*a* are received in the correspondingly sized center openings of cylindrical bodies 21, 21*a* (see FIG. 1). The cover plate 18 is now secured to the housing 12.

Lock assembly 10 is now ready for mounting on safe deposit door 27. As shown in FIG. 3, insert lock guides 20, 20*a* are received in openings 49 of the door. The safe deposit door is advantageously positioned flush on top of the wings 42 and the resilient retainer arms 35 to assure positive engagement of the locking detents 44. Screws 51 are used to attach the mounting assembly 10 (see FIG. 3) to the door 27.

With this design, lock plugs 14, 14*a* are received in the corresponding size insert lock guides 20, 20*a* to provide the desired match for previously installed safe deposit boxes. Cover plate 18, as the basic component for all situations, can be stamped at low manufacturing cost. In addition, the feature of providing cover plate 18 and insert lock guides 20, 20*a* as separate articles of manufacture reduces the inventory a supplier of these parts is required to maintain.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principals of the invention and its practical application to thereby enable others skilled in the art to best utilize the invention in various embodiments and with various modifications as are suited to the particular use contemplated. It is intended that the scope of the invention be defined by the claims appended thereto.

I claim:

1. A lock mounting assembly for positioning different size insert lock guides of substantially cylindrical configuration in a safe deposit door or the like, comprising: a lock housing; a first lock guide having a substantially small diameter and a second lock guide having a relatively large diameter, a cover plate having cutout portions of substantially the same size for receiving the first and second insert lock guides; and retaining means for securing the guides to the cover plate including a universal mounting base on each guide and received in the corresponding cutout portions, each mounting base of the small and large lock guides having substantially the same size outer diameter to be received in said cutout portions, first and second locking elements spaced circumferentially from each other on each base, said first locking element engaging a top surface of the cover plate surrounding said cutout portion, said second locking element engaging a bottom surface of the cover plate.

2. A lock mounting assembly according to claim 1, wherein said first locking element includes a pair of bayonet-type wings projecting outwardly from the universal mounting base.

3. A lock mounting assembly according to claim 2, wherein said second locking element includes a pair of locking wedges projecting outwardly from the universal mounting base.

4. A lock mounting assembly according to claim 3, wherein said retaining means includes a pair of resilient retainer arms on said cover plate positioned to receive said locking wedges in mating engagement.

5. A lock mounting assembly according to claim 4, wherein said cutout portions include a substantially circular opening receiving a substantially cylindrical universal mounting base, and a pair of diametrically opposed crescent shaped slots communicating with the circular opening, said crescent shaped slots dimensioned to receive the locking wedges to enable rotation of the locking wedges into locking engagement with the resilient retainer arms.

6. A lock mounting assembly according to claim 5, wherein said resilient retainer arms overlap above an end portion of the crescent shaped slots.

7. A lock mounting assembly according to claim 6, further comprising locking detent means positioned between the resilient retainer arms and mating locking wedges for locking.

8. A lock mounting assembly according to claim 7, wherein said locking detent means includes a rounded projection formed on the resilient retainer arms engaging a corresponding depression on the locking wedges.

9. A lock mounting assembly according to claim 3, wherein said locking wedges and bayonet-type wings are respectively formed in diametrically opposed locations on the universal mounting base and lie in substantially the same plane.

10. A lock mounting assembly according to claim 5, wherein said crescent-shaped slots extend substantially circumferentially around the circular opening approximately 120°.

11. A lock mounting assembly for positioning different size insert lock guides of substantially cylindrical configuration in a safe deposit door or the like, comprising: a lock housing; a first lock guide having a substantially small diameter and a second lock guide having a relatively large diameter, a cover plate having cutout portions of substantially the same size for receiving the first and second insert lock guides; and retaining means for securing the guides to the cover plate including a universal mounting base on each guide and received in the corresponding cutout portions, each mounting base of the small and large lock guides having substantially the same size outer diameter to be received in said cutout portion, first and second locking elements on each base spaced radially from the center of said base to share a substantially common radius and spaced circumferentially from each other, said base on said first lock guide projecting radially outwardly from said guide, said first locking element engaging a top surface of the cover plate surrounding said cutout portion, said second locking element engaging a bottom surface of the cover plate.

12. A lock mounting assembly for positioning different size insert lock guides of substantially cylindrical configuration in a safe deposit door or the like, comprising: a lock housing; a first lock guide having a substantially small diameter and a second lock guide having a relatively large diameter, a cover plate having cutout portions of substantially the same size for receiving the first and second insert lock guides; and retaining means for securing the guides to the cover plate including a universal mounting base on each guide and received in the corresponding cutout portions, each mounting base of the small and large lock guides having substantially the same size outer diameter to be received in said cutout portions, first and second locking means engaging the universal mounting base on each guide for holding the guides in position in the housing.

13. A lock mounting assembly according to claim 12 wherein said locking means for each guide includes a section of said cover plate surrounding said cutout portion, the bottom surface of said section of the plate engaging said mounting base to secure the guide.

14. A lock mounting assembly according to claim 13 wherein said locking means for each guide further includes a second section of said cover plate, the top surface of said second section engaging said mounting base to secure the guide.

* * * * *